US006945042B1

(12) United States Patent
Walckner

(10) Patent No.: US 6,945,042 B1
(45) Date of Patent: Sep. 20, 2005

(54) SYSTEM FOR GENERATING FLUID MOVEMENT

(76) Inventor: James R. Walckner, 4 Carter Dr., Framingham, MA (US) 01701

( * ) Notice: Subject to any disclaimer, the term of this patent is extended or adjusted under 35 U.S.C. 154(b) by 0 days.

(21) Appl. No.: 10/928,069

(22) Filed: Aug. 27, 2004

(51) Int. Cl.[7] ..... F03C 1/00
(52) U.S. Cl. ..... 60/495; 60/496
(58) Field of Search ..... 60/641.2, 495, 60/496

(56) References Cited

U.S. PATENT DOCUMENTS

| | | | | |
|---|---|---|---|---|
| 3,952,517 | A | 4/1976 | Decker | |
| 4,036,017 | A | 7/1977 | Sigel | |
| 4,207,741 | A | 6/1980 | Rainey | |
| 4,209,271 | A * | 6/1980 | McCabe et al. | 405/210 |
| 4,222,238 | A * | 9/1980 | McCulloch | 60/398 |
| 4,305,003 | A | 12/1981 | Basurto et al. | |
| 4,324,099 | A | 4/1982 | Palomer | |
| 4,508,971 | A | 4/1985 | Bailey | |
| 4,622,473 | A | 11/1986 | Curry | |
| 4,698,969 | A | 10/1987 | Raichlen et al. | |
| 4,726,188 | A | 2/1988 | Woolfolk | |
| 4,843,250 | A | 6/1989 | Stupakis | |
| 4,883,411 | A | 11/1989 | Windle | |
| 6,269,638 | B1 | 8/2001 | Murata | |
| 6,457,307 | B1 * | 10/2002 | Feldman et al. | 60/398 |
| 6,731,035 | B2 | 5/2004 | Mu et al. | |
| 6,772,592 | B2 * | 8/2004 | Gerber et al. | 60/495 |
| 6,781,253 | B2 * | 8/2004 | Newman | 290/53 |

* cited by examiner

*Primary Examiner*—Hoang Nguyen

(57) ABSTRACT

A system for moving fluid from a lower elevation to a higher elevation and then returning fluid to its original level, or alternatively to a level above its beginning lower elevation comprising a variable volume chamber with a weighted lower component upon which the effect of gravity is greater than the weight of fluid and other negative effects of the fluid in the fluid supply line, thus creating a vacuum and drawing material into the chamber which has an upper section and lower section connected by means of a flexible membrane, and such chamber is capable of retaining fluid.

21 Claims, 9 Drawing Sheets

Use for irrigation

Use to drive pump or other device

Multiple Apparatuses Creating a Continuous Flow of Fluid
This example has six apparatuses drawing fluid from a single source
Top Down View

SYSTEM FOR GENERATING FLUID MOVEMENT

BACKGROUND OF THE INVENTION

It is an object of this invention to provide a new system that predictably and constantly provides for the movement of fluid (e.g., fluids such as water or other suitable fluids) and to use that movement for useful work; such as to generate energy or provide for irrigation. The preferred system does this by means of a self contained environment that automatically recycles through its fluid movement processes. The system does not require the burning of a combustible fuel, the use of nuclear power sources, or rely on the unpredictable natural sources of energy (hydro and wind), and does not kill scores of wildlife by the turning of hydro or wind powered blades.

Another object of this invention is to provide a system that can be mass produced, be easily replicated, be easily sized for the supply of fluid or energy desired, be easily located, and be easily scaled to accommodate the requirements of the area or region.

Another object of this invention is to provide an energy generation system that reduces the cost of energy, including the risk associated with some types of energy generation systems, both long term and short term.

Another object of this invention is to provide a system which utilizes the gravitational forces applied to weight to create fluid movement and energy, and does not require a lower level fluid pool to receive fluids from a higher level or the movement of waves which are each typical requirements of these systems. Typical fluid based systems rely on wave action or the head of one elevation of fluid which is higher than a second elevation whereby energy is created through the movement of fluid from the higher elevation to the lower elevation. This invention relies on neither of these to serve as an energy source.

Another object of this invention is to provide a system whereby water can be moved from a lower source to higher areas for irrigation without external power sources.

Another object or this invention is to use high density buoyant fluid to reduce the size of self contained energy producing systems while maintaining a comparable supply of energy.

SUMMARY OF THE INVENTION

Disclosed is an apparatus and method for moving fluid in a self contained system that comprises a weighted variable volume chamber which includes a buoyancy component, a buoyancy chamber and a supply of source fluid and that includes valves, pipes and backflow prevention devices. The movement of fluid is employed for useful work, such as driving an electric generator, or moving fluid from a lower elevation to a higher elevation.

As for other uses, this system (and the method) can be used for powering other devices such as pumps, and thus can be used for moving fluids into a tank or other assembly (such as pumping from a reservoir to a water tank, or from an oil tanker into oil tanks, etc.). Similarly, the energy derived from the vacuum placed on the supply line could also be used to drive a pump to do the work (rather than try to move these materials through the system). These pumps could be used to drive any other kind of fluid (e.g., move fluids such as petroleum products from tankers to tanks, etc.). Other devices that could be driven directly from the system include other material handling systems, such as systems used to move solids (such as grain and other products which are moved by screw type mechanisms; using pumps that are known to move solids). The skilled artisan can readily adapt this system and method to accomplish other types of useful work based upon the present disclosure. The nature of such useful work does not dictate the nature of the present invention; rather the system and method taught herein simply permit many different types of useful work to be performed.

In a preferred embodiment, the weighted variable volume chamber, while airtight, draws fluid from a lower elevation source of fluid, which in a self contained system is a holding tank, into the chamber at a higher elevation and through this draw moves fluid past an electric generator. Upon completion of the draw and filling of the weighted variable volume chamber a valve opens to allow the chamber to backfill with air as a valve opens to evacuate the fluid in the weighted variable volume chamber into the buoyancy chamber. A backflow prevention device prevents the supply side of the system from losing the prime of the supply side of the system. A buoyancy component on the weighted variable volume chamber reacts to the fluid level in the buoyancy chamber returning the weighted variable volume chamber to its original position. Valves are closed in the weighted variable volume chamber to return it to an airtight stage, and valves are opened in the buoyancy chamber to allow the fluid to be evacuated or to return the fluid to the holding tank in a self contained system. Evacuating the fluid from the buoyancy chamber eliminates the buoyancy of the weighted component of the variable volume chamber, and the cycle repeats itself.

Embodiments of this system have been designed to capture energy from movement of fluid as it passes from a lower supply source to a chamber at a higher elevation, and as an additional component, the system can be designed to also capture energy (power) by more traditional means, e.g., as the fluid, in subsequent stages, passes from a higher elevation to a lower elevation, such as when it moves from the weighted variable volume chamber into the buoyancy chamber, or from the buoyancy chamber to the holding tank. In a non closed system, such as an irrigation system, the fluid pumped to the higher elevation is simply expelled from the buoyancy chamber at the end of that cycle for use at that elevation.

When first constructed, the system will have the lower assembly of the variable volume chamber at the bottom of its cycle, but there will be no supply of fluid in the chamber. The weight of the lower assembly of the variable volume chamber will be in an expanded state—i.e., as if full of fluid. To prepare the system for operation the supply line has to be filled. This process requires an external source for pumping fluid into and filling the supply lines and removing air from the supply lines. Additionally the area in the variable volume chamber that receives the vertical stroke of supply line as the lower assembly moves vertically through its operating processes is filled with the same fluid material. This process creates a primed supply environment. The buoyancy chamber is filled with fluid using a pumping mechanism and an external power source. This step positions the lower assembly of the variable volume chamber to its highest point, at which point the desired operating cycle is ready to begin.

Once the desired operating cycle has begun, the system is designed to operate in a self contained manner without the additional use of an external power source. Fluid lost to evaporation will need to be periodically replenished, but that can be accomplished without the need to restart the operating cycle, so long as sufficient fluid is maintained in the system for continuous operation. Gravitational force is relied upon to act on the weighted component in an airtight variable volume chamber to draw fluid from a source with a lower height or elevation to the variable volume chamber at a higher elevation. The amount of weight applied to the variable volume chamber offset by the volume of fluid in the supply line and certain effects of friction of fluid passing through the supply line, generator and backflow prevention device will determine the net amount of flow and force available in the supply line, which may or may not be used for generating energy subject to the intended use of bringing fluid from a lower supply source to a higher elevation. After completing a draw of fluid and filling the airtight chamber, the fluid is evacuated into a buoyancy chamber.

This invention is based in part on Archimedes principle which states that the buoyant force acting upon a body submerged in a fluid is equal to the weight of the body of fluid displaced by the body. Through calculations made, the upper airtight chamber is sized to draw an amount of fluid equal to or greater than the amount of fluid required in the buoyancy chamber to float the lower assembly of the variable volume chamber to its original starting position. After the fluid in the buoyancy chamber is used to float the weighted variable volume chamber to its original starting position, the fluid in the buoyancy chamber is evacuated to either the holding tank or to irrigation.

In preferred embodiments, the system relies upon materials that provide the integrity of a variable volume airtight environment, and the flexible membrane materials and design of the chamber necessary to secure the location of the flexible materials.

The gravitational force applied to the weight and to fluid drawn into the airtight variable volume chamber exerts a force that is used for energy generation, and does so until the chamber is filled at which time a switch or volume based flow measuring device triggers the evacuation stage, where the fluid is evacuated into the buoyancy chamber. The fluid in the buoyancy chamber is sufficient to raise the upper chamber to its original starting position, and then fluid in the buoyancy chamber is evacuated to the holding chamber or to irrigation.

Accordingly, one embodiment of the invention comprises a system for moving fluid from a source located at a lower elevation to a higher elevation and then either returning the fluid to its source or alternatively to a level above its beginning lower elevation. This system comprises:

- a buoyancy chamber adapted for holding and releasing a fluid;
- a variable volume chamber adapted for holding and releasing a fluid, the chamber being located above the buoyancy chamber and comprising an upper section and a lower section connected to one another by a flexible membrane;
- the lower section of the variable volume chamber comprising a movable weighted lower component upon which the effect of gravity is greater than the weight of the chamber, when the buoyancy chamber is at least partially free of fluid;
- the upper section of the variable volume chamber being operatively connected to a source of fluid;
- means for raising the weighted movable lower component of the variable volume chamber into an elevated position inside the buoyancy chamber;
- means for releasing fluid from the buoyancy chamber, whereby gravity acting upon the movable weighted lower component of the chamber pulls the weighted lower component down into the buoyancy chamber, thereby creating a vacuum in the variable volume chamber which draws fluid from the fluid source up into the flexible membrane of the variable volume chamber; and
- means for releasing fluid from the variable volume chamber into the buoyancy chamber, thereby floating the weighted movable lower component inside the buoyancy chamber and raising the variable volume chamber to an elevated position.

Advantageously, the system of the invention is based upon the following cycle being constantly repeated (as desired by the operator):

(a) fluid is drawn by vacuum from the source at a lower elevation into the variable volume chamber at a higher elevation, (b) fluid is evacuated to the buoyancy chamber and is there used to float the variable volume chamber to an elevated position, and (c) fluid is then returned to the source from the buoyancy chamber.

Flow control of the system of the present invention is advantageously provided by manual operation and/or computer control of valves and backflow prevention devices. In one embodiment, after the filling of the weighted variable volume chamber, a first valve is opened to allow the chamber to fill with air and a second valve is opened to release the fluid in the variable volume chamber into the buoyancy chamber. Similarly, a backflow prevention device is used to prevent the supply side of the system from losing the fluid of the supply side of the system. Likewise, one or more valves are closed in the weighted variable volume chamber to return it to a vacuum ready state, and one or more valves are opened in the buoyancy chamber to allow the fluid to be evacuated or to return the fluid to the holding tank. The evacuation of the fluid from the buoyancy chamber eliminates the buoyancy of the weighted component of the variable volume chamber, and the cycle repeats itself.

Generally, the source of fluid for the system comprises a fluid holding tank, into which fluid is returned upon release from the buoyancy chamber. Other sources include wells, lakes and ponds, rivers and streams, and sea water.

Movement of fluid in the system of the present invention is used to do useful work, such as the generation of power by passage of the fluid through a turbine or generator. Advantageously, the system is designed to capture kinetic energy from moving fluids in at least two ways;

- first, as fluid passes from a lower supply source to a chamber at a higher elevation, and
- second, as the fluid, in subsequent stages, passes from a higher elevation to a lower elevation.

Similarly, the system is designed to capture kinetic energy when fluid moves from the weighted variable volume chamber into the buoyancy chamber. Likewise, the system is designed to capture kinetic energy when fluid moves from the buoyancy chamber to the holding tank.

Another embodiment of the invention comprises a method of moving fluid from a source located at a lower elevation to a higher elevation and then either returning the fluid to its source and its original elevation, or alternatively to a level above its beginning lower elevation comprising the steps of:

(a) filling a buoyancy chamber with a fluid, said buoyancy chamber being located beneath a variable volume chamber fillable with a fluid, the chamber comprising an upper section and a lower section connected to one another by a flexible membrane; the upper section of the variable volume chamber being operatively connected to a source of fluid; and the lower section of the chamber comprising a movable weighted lower component upon which the effect of gravity is greater than the weight of the chamber;

(b) using the fluid in the buoyancy chamber to raise the weighted movable lower component of the variable volume chamber into an elevated position inside the buoyancy chamber; and (c) releasing the fluid from the buoyancy chamber, whereby gravity acting upon the movable weighted lower component of the chamber pulls the weighted lower component down into the buoyancy chamber and creates a vacuum which draws fluid from a fluid source up into the flexible membrane of the variable volume chamber.

Advantageously, the method of the invention is based upon the following cycle being constantly repeated (as desired by the operator):

(a) drawing fluid by vacuum from the source a lower elevation into the variable volume chamber at a higher elevation, (b) releasing fluid from the variable volume chamber into the buoyancy chamber, thereby floating the variable volume chamber to an elevated position, and (c) releasing the fluid from the buoyancy chamber so that steps (a) and (b) can be performed again.

Flow control of fluid in the method of the present invention is advantageously provided by manual operation and/or computer control of valves and backflow prevention devices. In one embodiment, after the filling of the weighted variable volume chamber, a first valve is opened to allow the chamber to fill with air and a second valve is opened to release the fluid in the variable volume chamber into the buoyancy chamber. Similarly, a backflow prevention device is used to prevent the supply side of the system from losing the fluid of the supply side of the system. Likewise, one or more valves are closed in the weighted variable volume chamber to return it to a vacuum ready state, and one or more valves are opened in the buoyancy chamber to allow the fluid to be evacuated or to return the fluid to the holding tank. The evacuation of the fluid from the buoyancy chamber eliminates the buoyancy of the weighted component of the variable volume chamber, and the cycle repeats itself.

Movement of fluid in the method of the present invention is used to do useful work, such as the generation of power by passage of the fluid through a turbine or generator. Advantageously, the method provides for capture of kinetic energy from moving fluids in at least two ways;

first, as fluid passes from a lower supply source to a chamber at a higher elevation, and second, as the fluid, in subsequent stages, passes from a higher elevation to a lower elevation.

Similarly, the method of the present invention is designed to capture kinetic energy when fluid moves from the weighted variable volume chamber into the buoyancy chamber. Likewise, the system is designed to capture kinetic energy when fluid moves from the buoyancy chamber to the holding tank.

BRIEF DESCRIPTION OF THE DRAWINGS

The present invention is described with reference to the following drawings, in which.

DETAILED DESCRIPTION OF A PREFERRED EMBODIMENT

Figure 1:
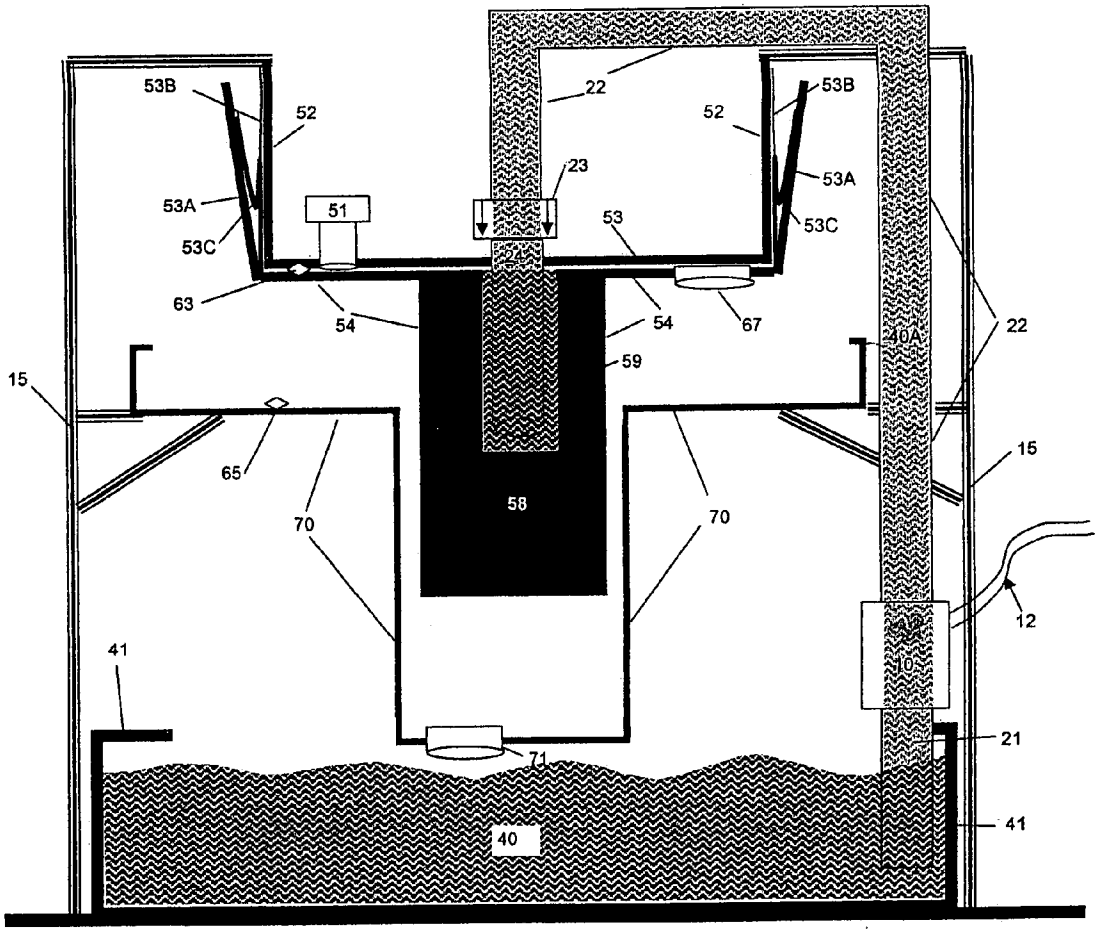
FIG. 1 is a cross sectional diagram of the apparatus according to the present invention as it would appear at one point during a cycle of operation thereof.

Referring first to FIG. 1, the supply tank 41 is for containing the fluid reservoir 40. Fluid exits through a supply line 21. In the present instance fluid reservoir 40 is a part of a self contained system. Fluid reservoir 40 alternatively can comprise another suitable reservoir containing fluid. In the illustration of FIG. 1 supply line 21 is disposed generally vertically towards the variable volume chamber as will be described further on in this presentation. Supply line 21, generator 10 and supply line 22 maintain a supply of fluid 40A. Supply line 21 connects to a generator 10 whereby the flow of fluid is converted to energy. Generator 10 provides energy for consumption outside of the self contained system 12. Energy for operating automated controls and valves comes from the energy output of the Generator 10. Generator 10 connects to supply line 22 feeding the fluid to the variable volume chamber. Supply line 22 connects to backflow prevention device 23. During subsequent operating cycles, backflow prevention device 23 prevents the supply side of the present invention comprised of supply line 21, generator 10, supply line 22 and in-flow supply fluid 40A from losing its prime during subsequent stages of the operating cycle that do not draw upon the supply side. The supply side of the system includes supply line 24. Supply line 24 extends into the variable volume chamber a distance suitable to remain submerged through all operating cycles. Framing 15 provides structure to hold all of the components of the system. The variable volume chamber comprised of the upper assembly including the top wall 53 and interior side wall 52 and the lower assembly including the exterior side wall 53A, bottom exterior walls 54 and interior wall 59. The upper assembly and lower assembly are connected by a flexible membrane 53B. The interior side wall 52 is connected to exterior side wall 53A by a flexible membrane 53B. A guide wall 53C keeps the lower assembly and upper assembly in alignment and guides the flexible membrane during a subsequent cycle. A part of the lower assembly of the variable volume chamber, the ballast-buoyancy component 58 combined with all of the components of the lower assembly comprises the weight subject to gravity that, during the charging cycle, creates the force to draw the fluid from the fluid reservoir through the supply side of the invention and into an expanding variable volume chamber. There is a distance between the outside diameter of supply line 24 and the inside diameter created in the lower assembly by interior wall 59 through which fluid drawn into the variable volume chamber fills the cavity created between the upper and lower assemblies. Fluid evacuation from the variable volume chamber occurs through valve 67. Air valve 51 located in the top wall opens to let the variable volume chamber back fill with air during the fluid evacuation through valve 67. The dimension of the ballast-buoyancy component 58 of the lower assembly is sized to be buoyant when introduced to a source of fluid in the buoyancy chamber, which becomes available as the fluid is evacuated from the variable volume chamber. Fluid expelled from the variable volume chamber is held in a non airtight tank comprised of walls 70 where the buoyancy of the lower assembly in the fluid returns the lower assembly of the variable volume chamber to its original closed state. Upon completion of the cycle to return the variable volume chamber to its starting position fluid is returned through valve 71 into the original holding tank, or expelled outside of the system if used for irrigation. Switches 63 and 65 automatically sense when the lower assembly of the variable volume chamber is at its lowest or highest positions and when at its lowest position switch 65 triggers the system to open valve 67 to evacuate the fluid from the chamber and open air valve 51 to allow for the flow of air into the chamber. At its highest point, switch 63 triggers the system to close air valve 51, close valve 67 to close the variable volume chamber and open valve 71 to evacuate the fluid from buoyancy chamber.

Figure 2:
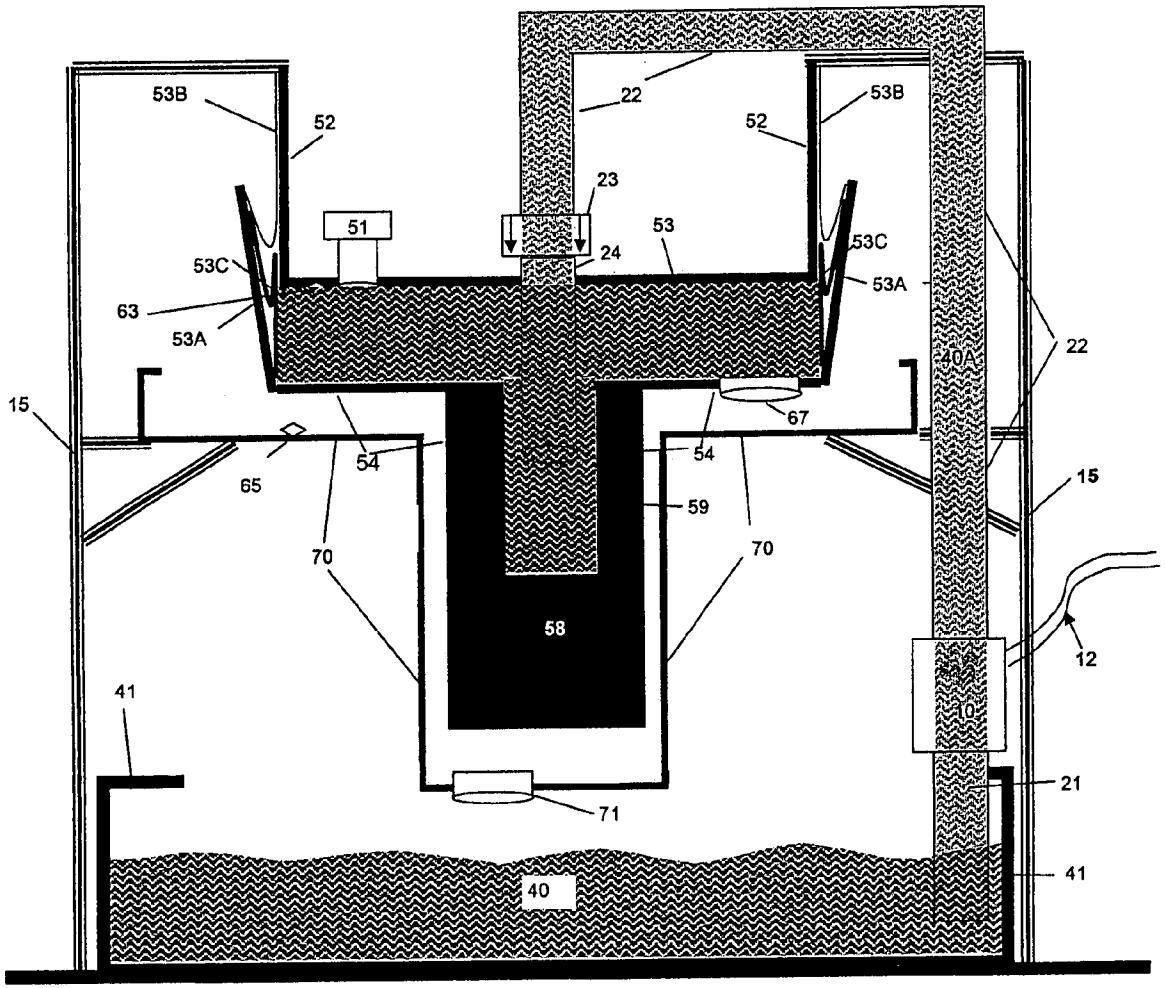
FIG. 2 is a cross sectional diagram of the first stage of the apparatus in process where the system is drawing fluid into an chamber that is at a higher elevation or height than the source material at another point of the operating cycle thereof.

FIG. 2 shows the depletion of fluid in the fluid reservoir 40 as fluid is drawn into the variable volume chamber and the lower assembly of the variable volume chamber, by way of the impact of gravity on the weight of this lower assembly, is drawn downward. The flexible membrane 53B is drawn tight against the interior side wall 52 due to the vacuum created within the chamber, a vacuum strong enough to draw fluid from a lower elevation to a higher elevation. There is nothing in the tank comprised of walls 70 and no outside forces acting negatively against the force of gravity, other then the fluid in the supply line itself, which is overcome by the weight of the lower assembly.

Figure 3:
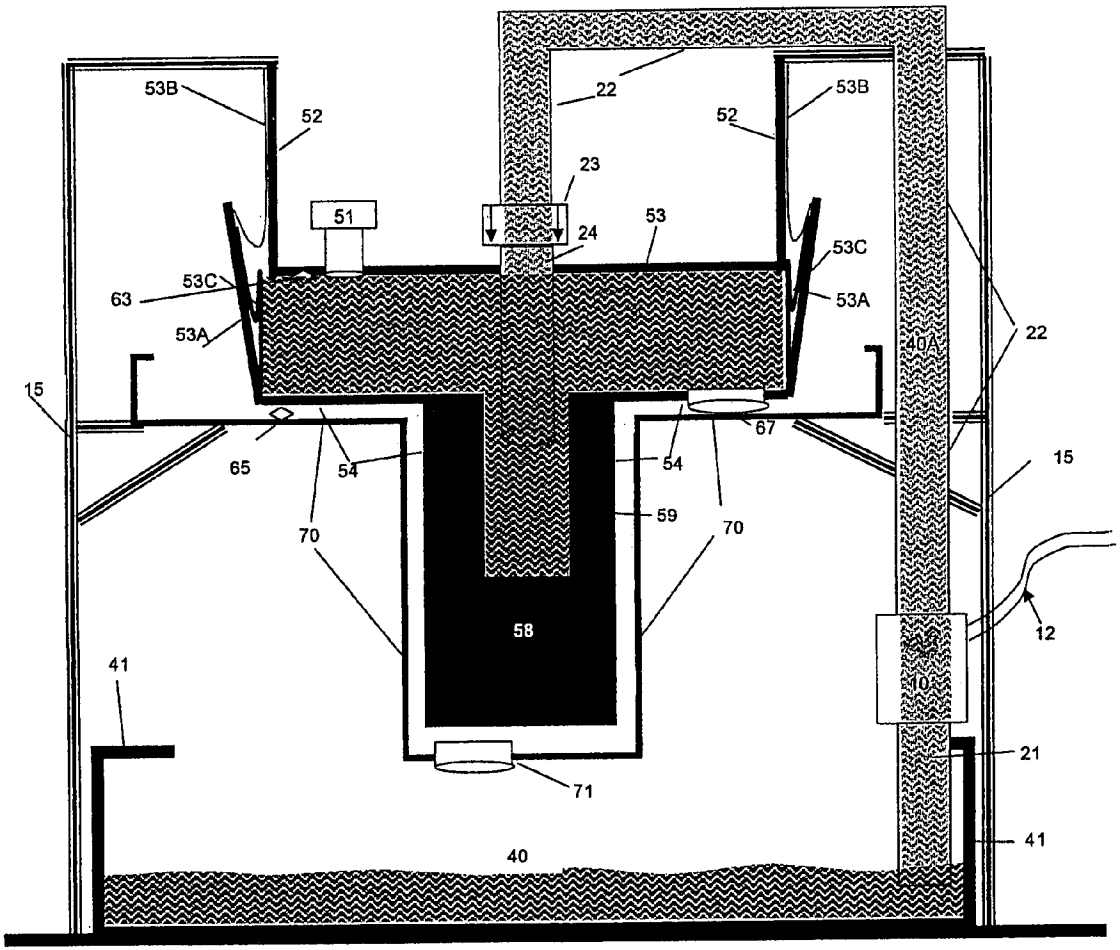
FIG. 3 is a cross sectional diagram of a fully charged first stage of the apparatus at another point of the operating cycle thereof.

FIG. 3 shows that fluid has filled the variable volume chamber and the further depletion of fluid in tank 41. Bottom exterior wall 54 is triggering switch 65. Triggering of switch 65 closes valve 71 to close the buoyancy chamber which will receive fluid evacuated from the variable volume chamber, opens air valve 51 and opens valve 67. Fluid flows from the variable volume chamber into the tank created by walls 70, and fills an area sufficient and with a volume of fluid sufficient to float the lower assembly.

Figure 4:
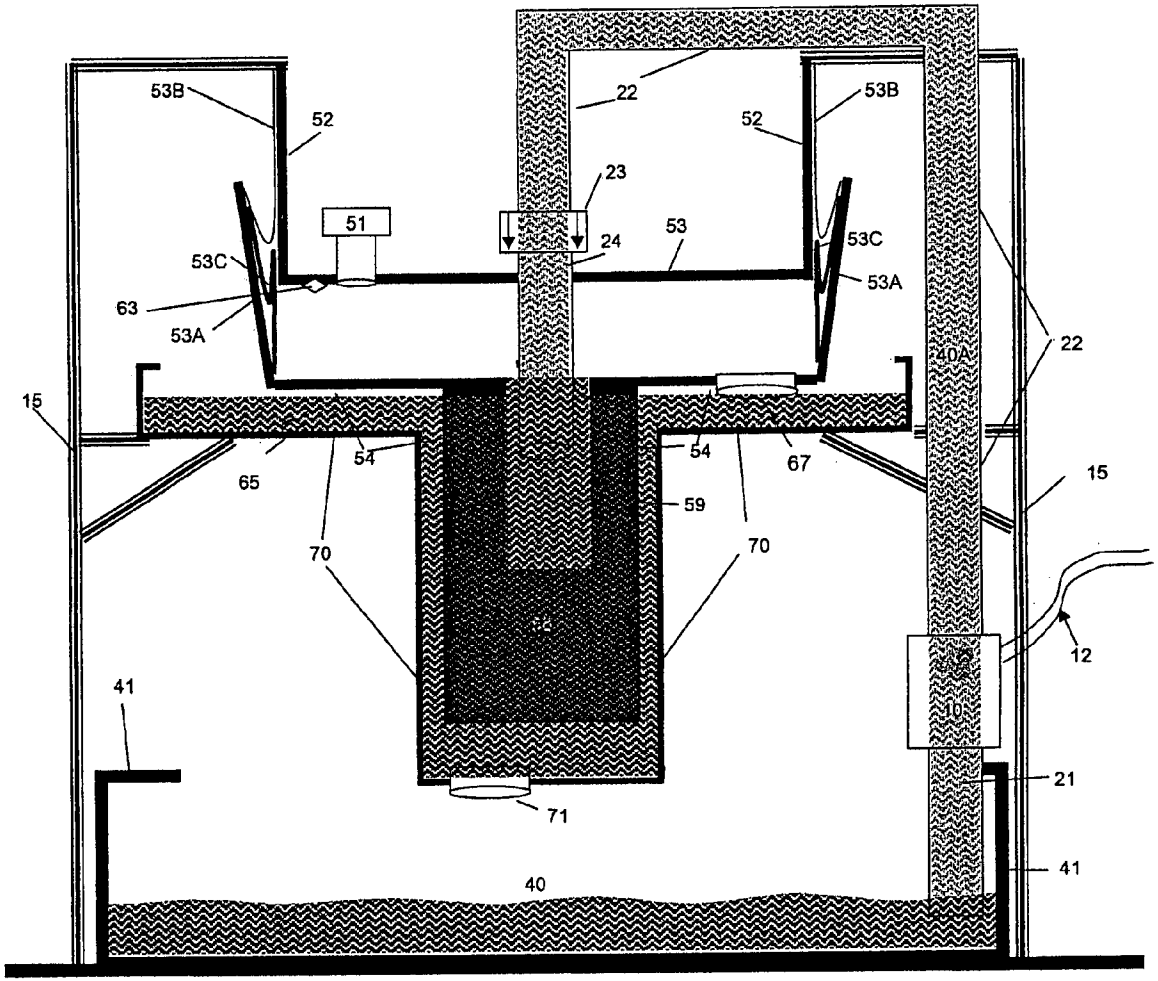
FIG. 4 is a cross sectional diagram of the evacuation of fluids accumulated during the first stage in process at another point of the operating cycle thereof.

In FIG. 4 the fluid has moved by gravity, from a higher location into the tank created by walls 70. As the fluid flows from the variable volume chamber, this chamber is filled with air entering through air valve 51.

Figure 5:
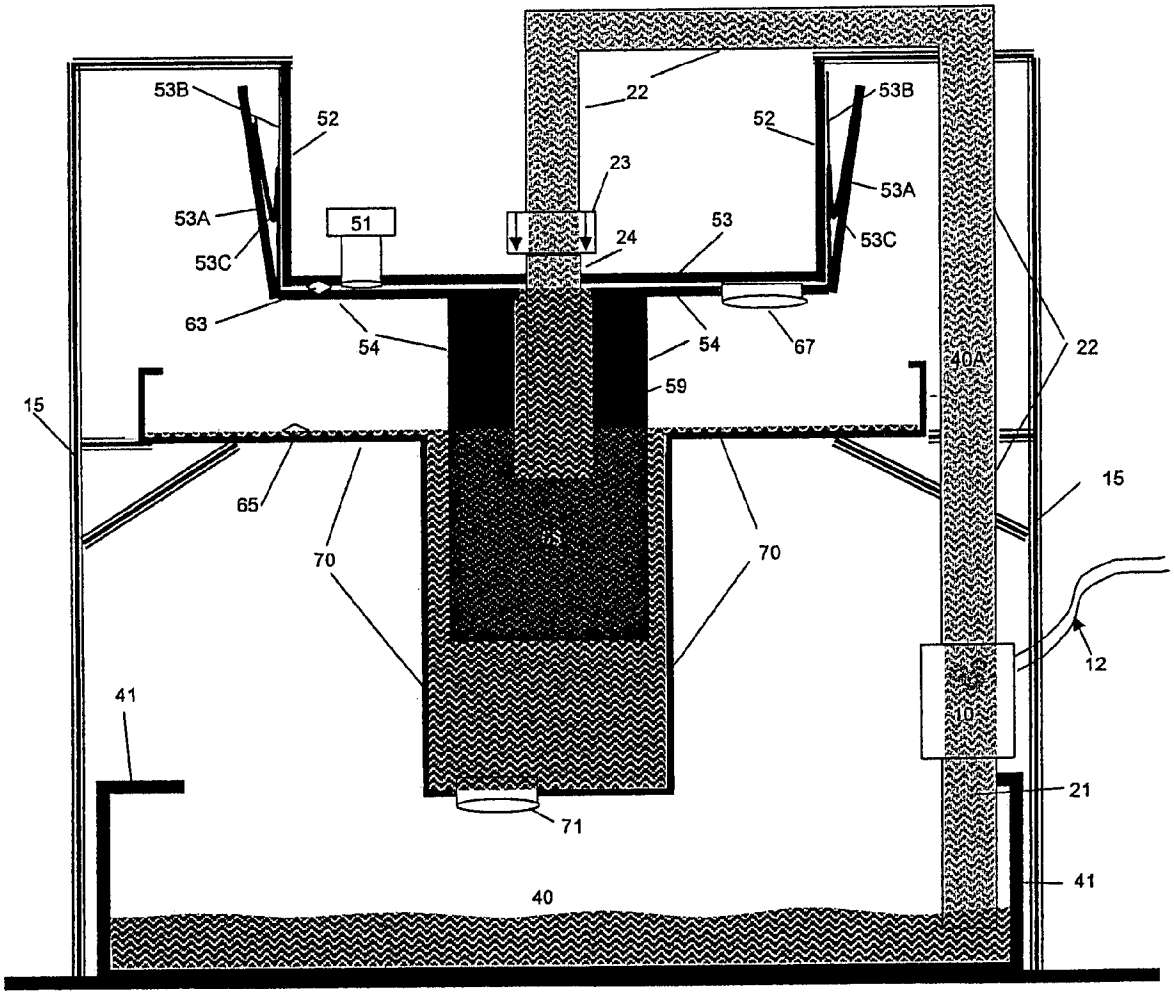
FIG. 5 is a cross sectional diagram of the recharging of the first stage, where the chamber is returned to its starting position at another point of the operating cycle thereof.

FIG. 5 shows that the buoyancy created by the dimension of the ballast-buoyancy element 58 is such that only a portion of the dimension of this element is necessary for floatation of the lower assembly of the variable volume chamber. As the lower assembly floats to its original position as depicted in FIG. 1, excess fluid that was evacuated from the variable volume chamber into the tank created by walls 70 replaces the area vacated by the retreating variable volume chamber.

Figure 6:
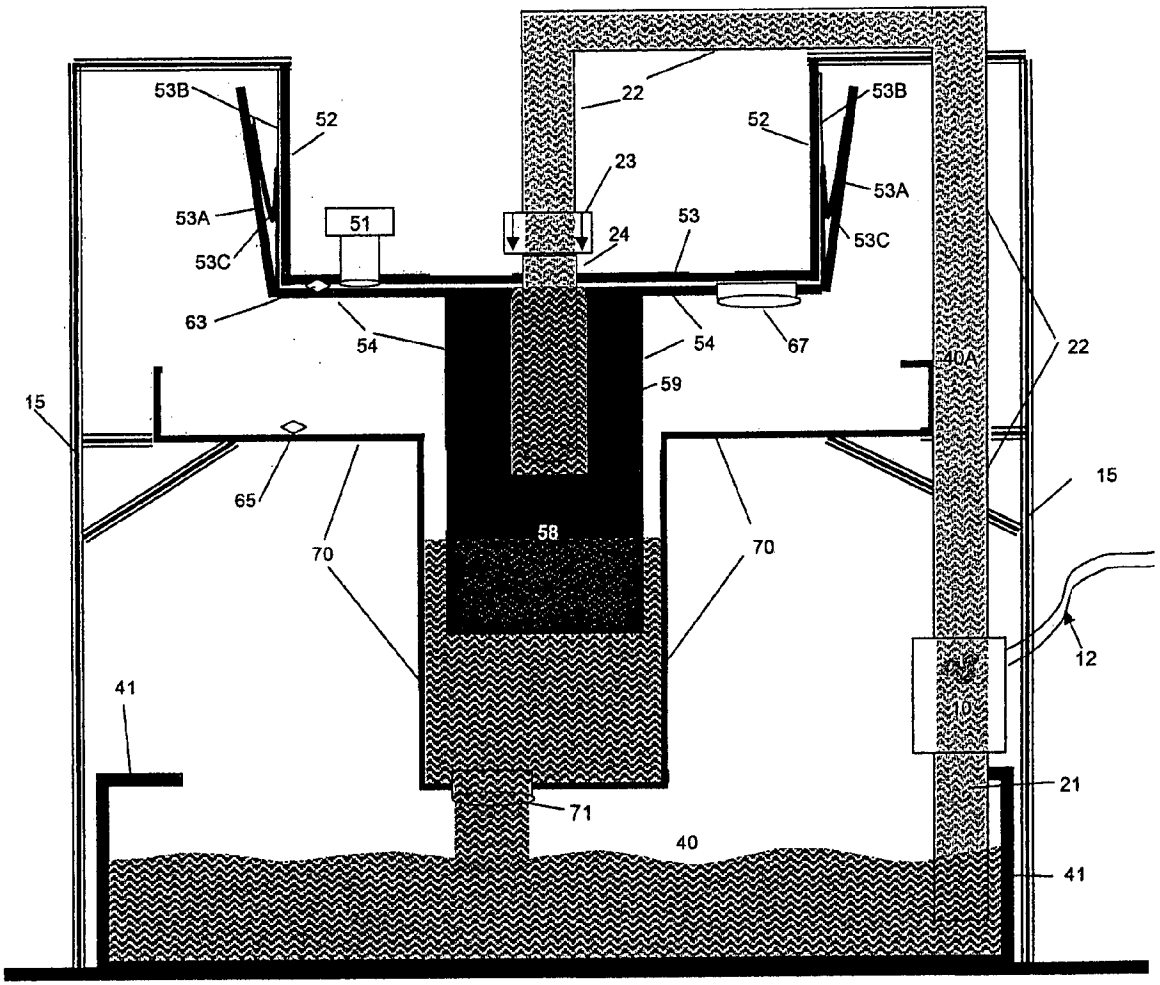
FIG. 6 is a cross sectional diagram of the evacuation of fluids in the buoyancy stage to a source supply tank at another point of the operating cycle thereof.

FIG. 6 shows the bottom exterior wall 54 at its highest location which triggers switch 63. Triggering switch 63 closes both air valve 51 and valve 67 to return the variable volume chamber to an airtight closed state and opens valve 71 and fluid evacuates the buoyancy tank created by walls 70 into the fluid reservoir 40. As the buoyancy for the lower assembly of the variable volume chamber is eliminated, gravity will again set the process of drawing fluid into the variable volume chamber.

In the present example, a one hundred ton lower assembly fed by a supply line of 4 foot in diameter 13 feet above a fluid supply would draw fluid, water in this case, with a net vacuum lift of 189,877 pounds with a force of 104 pounds per square inch, less adjustments for friction, vortexes and the impact of valves and backflow prevention devices that impact the flow of fluid. As the fluid becomes a part of the variable volume chamber it increases the weight of the lower chamber and increases the measurable force acting upon the reservoir.

In a newly constructed system the lower assembly of the variable volume chamber is at the bottom of its cycle as in FIG. 3, however there is no supply of fluid in the chamber. The weight of the lower assembly of the variable volume chamber will be in an expanded state as if full of fluid. As the lower chamber is assembled it is anticipated that it may be resting on the buoyancy tank unless other provisions for supporting it have been made. To prepare the system for operation the supply line has to be filled. Valves which are not displayed in the diagrams but are necessary for the initial set-up of the system help to control the filling of the supply line from and including supply line 21 through to 24. This process requires an external source for pumping fluid into and filling the supply lines, and includes a process by which all air is removed from the supply line. Additionally the area in the variable volume chamber that receives the vertical stroke of supply line 24 as the lower assembly moves vertically through its operating processes is filled with the same fluid material. This area is an internal area within the ballast-buoyancy chamber 58 that is always full of fluid to help maintain the prime of the feeder supply line. This process creates a primed supply environment. With valve 67 and valve 51 open, the buoyancy chamber is filled with fluid from the fluid reservoir 40 using a pumping mechanism requiring an external power source. This step repositions the lower assembly of the variable volume chamber to its highest point at which normal operating processes may begin. Valve 67 and valve 51 will be closed to seal the system for drawing fluid from the fluid reservoir. The valves that were used to close the supply line during the priming of the supply line will be opened. Valve 71 which has been closed during this initial process is opened, and the fluid in the buoyancy chamber evacuates back to the fluid reservoir.

Note also that the system has components that are open to atmosphere and as such will experience a loss of fluid due to evaporation, and it is expected that a replenishment of fluid will be required from external sources to maintain the fluid levels necessary for the operation of the apparatus.

During the start-up of the system, and in subsequent cycles of the system, as the fluid evacuates the buoyancy chamber through valve 71, the weight of the lower assembly of the variable volume chamber will no longer be fully buoyant, and gravity will act upon this weight creating the force necessary to pull fluid through the supply line from the fluid reservoir. The variable volume chamber will fill with fluid as shown in FIG. 2 and will continue to fill until such time as the filling process triggers a switch as in switch 65. This will communicate to a control panel or computer that will direct the opening of valves 67 and 51 which will cause the fluid accumulated in the variable volume chamber to evacuate the chamber to a lower holding tank and will cause the variable volume chamber to fill with air. The fluid evacuated from the variable volume chamber goes into the buoyancy tank as described by the walls comprising it, walls 70. As the fluid flows into the buoyancy tank, at some point in the process the fluid surrounding the ballast-buoyancy element 58 will provide a buoyant force that will act upon the submerged body of the ballast-buoyancy element 58, and as more fluid evacuates the variable volume chamber it will increase the fluid in the buoyancy chamber thus increasing the height to which it will raise the lower assembly of the variable volume chamber. After completion of this cycle, and the return of the lower assembly of the variable volume chamber to its highest point, this will trigger a switch 63 which will communicate to a control panel or computer that will direct the closing of valves 67 and 51 to again seal the variable volume chamber and will direct the opening of valve 71. Opening of valve 71 will evacuate the fluid from the buoyancy chamber and it will return to the fluid reservoir 40. Alternatively, if this system is used for irrigation purposes, the fluid would be expelled from the system into a holding tank or some other related device which would then control the volume and flow for irrigation purposes. In this case, the fluid reservoir from which the fluid is drawn might well be a river, reservoir or lake.

Figure 7:
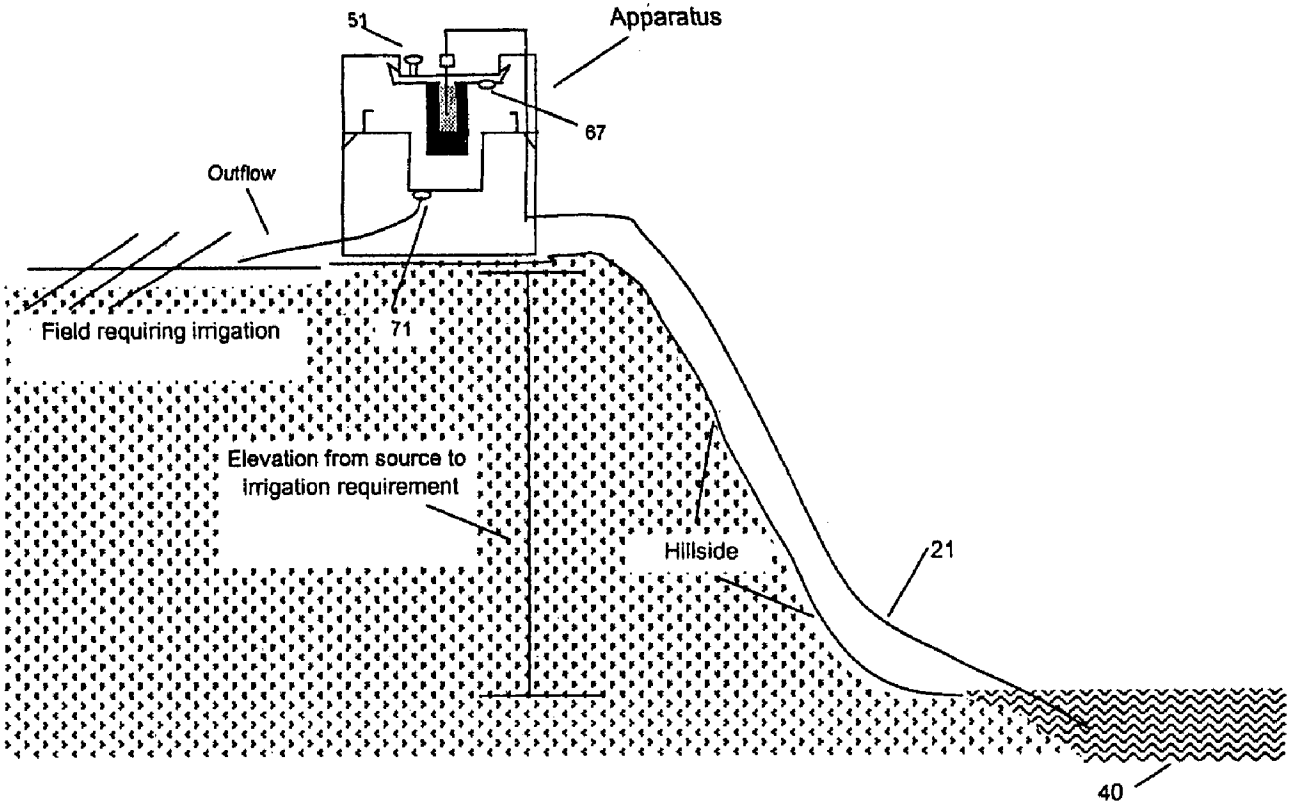
FIG. 7 is a cross sectional diagram of a system drawing water from a lower elevation to a higher elevation and evacuating the water for irrigation purposes according to another embodiment of the present invention

FIG. 7 shows a geographic impediment to the natural flow of water for irrigation. A complete apparatus is atop a hill at an elevation above the supply of water 40 and draws water up the hillside through a supply line 21 to an apparatus which then evacuates water to the buoyancy chamber which resets the variable volume chamber for another cycle, and then evacuates the water through valve 71 to a storage area for dispensing the water. The size of the apparatus including supply line combined with required supply volumes may make it necessary to have more than one apparatus along the elevation moving water in stages to the higher elevation.

Figure 8:
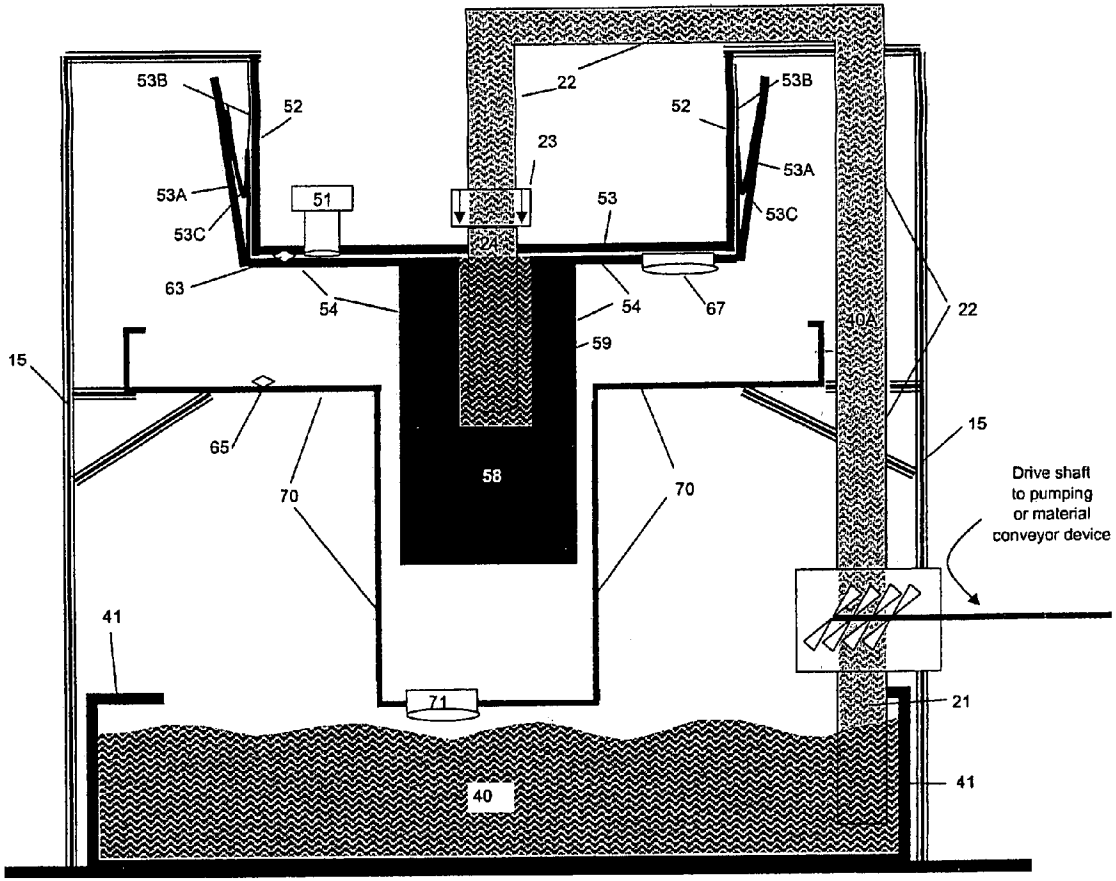
FIG. 8 is a cross sectional diagram of a system according to the present invention as it would appear at one point during the cycle of operation thereof where the system is used to drive a pump or other device

FIG. 8 shows the components of the apparatus as previously described and the generator (10 in FIG. 1) is replaced with a device for pumping or moving liquid and/or solid materials. Such device is powered as fluid is drawn from the fluid supply 40 through the supply line 21 and supply line 22 into the variable volume chamber comprised of the upper assembly including the top wall 53 and interior side wall 52 and the lower assembly including the exterior side wall 53A, bottom exterior walls 54 and interior wall 59. The upper assembly and lower assembly are connected by a flexible membrane 53B. The interior side wall 52 is connected to exterior side wall 53A by a flexible membrane 53B. A guide wall 53C keeps the lower assembly and upper assembly in alignment and guides the flexible membrane during a subsequent cycle. A part of the lower assembly of the variable volume chamber, the ballast-buoyancy component 58 combined with all of the components of the lower assembly comprises the weight subject to gravity that, during the charging cycle, creates the force to draw the fluid from the fluid reservoir through the supply side of the invention and into an expanding variable volume chamber. The components of the apparatus work as described in prior Figures. This figure shows that the useful work performed by the system is to drive a device used for purposes other than creating electricity.

Figure 9:
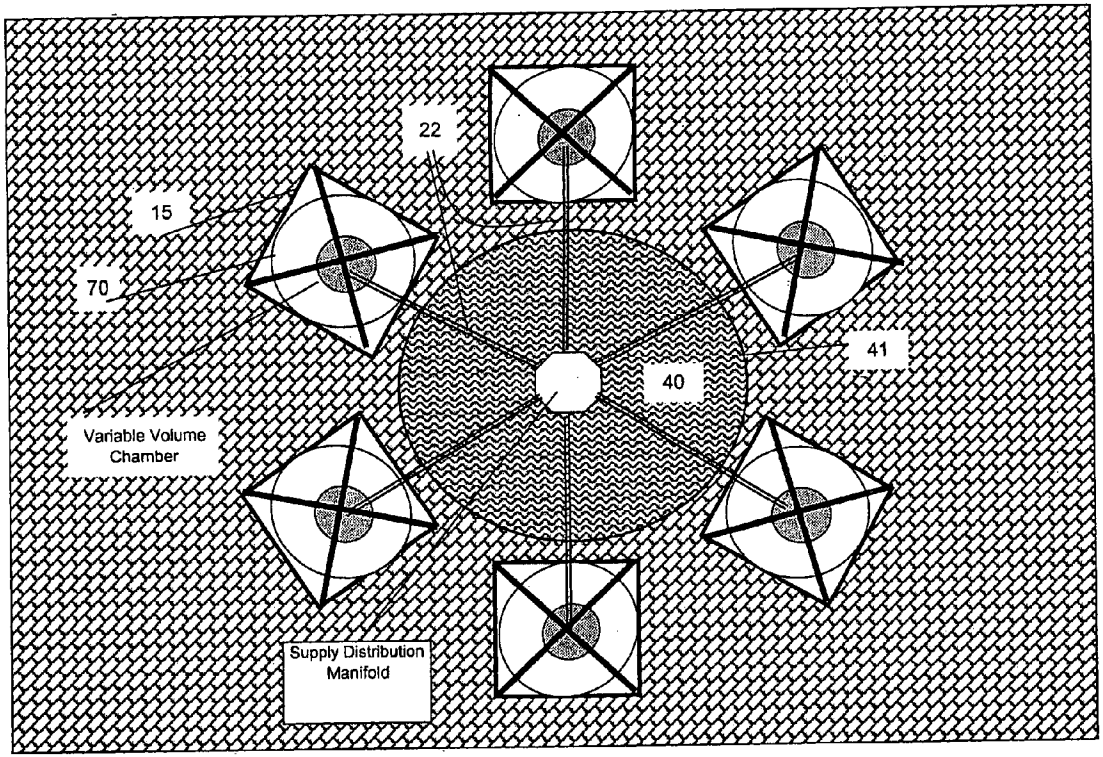
FIG. 9 is a top down view of multiple apparatuses drawing upon a common source of fluid according to another embodiment of the present invention.

FIG. 9 illustrates another embodiment of the present invention in which multiple multi-stage pumping apparatus are situated around a single fluid source 40 (e.g., the fluid reservoir, a water reservoir, lake or river, etc.) from which the multiple units can draw upon a common source of fluid simultaneously, while other apparatus evacuate their fluid from the variable volume chamber to the buoyancy chamber or from the buoyancy chamber to the fluid reservoir. In this configuration, the use of multiple individual apparatuses can provide a continuous draw on the fluid supply line for uninterrupted fluid flow. Other variations of the systems can be designed, e.g., with dual supply lines, generation systems and manifolds for distributing the supply line to multiple apparatuses so that maintenance can be performed on any aspect of the system without interrupting the flow of fluid, and the like. In this figure a supply distribution manifold is used to open the supply line to one or many apparatuses that are creating a draw on the fluid sources while other apparatuses are dispensing their fluids as they go through the other cycles of operation. All apparatus would preferably return fluid to a common reservoir, however such a system can be used for continuously drawing water from a reservoir for irrigation or for powering other devices on a continuous basis.

What is claimed is:

1. A system for moving fluid from a source located at a lower elevation to a higher elevation and then either returning the fluid to its source or alternatively to a level above its beginning lower elevation comprising:

a buoyancy chamber adapted for holding and releasing a fluid;

a variable volume chamber adapted for holding and releasing a fluid, the chamber being located above the buoyancy chamber and comprising an upper section and a lower section connected to one another by a flexible membrane;

the lower section of the variable volume chamber comprising a movable weighted lower component upon which the effect of gravity is greater than the weight of the chamber, when the buoyancy chamber is at least partially free of fluid;

the upper section of the variable volume chamber being operatively connected to a source of fluid;

means for raising the weighted movable lower component of the variable volume chamber into an elevated position inside the buoyancy chamber;

means for releasing fluid from the buoyancy chamber, whereby gravity acting upon the movable weighted lower component of the chamber pulls the weighted lower component down into the buoyancy chamber, thereby creating a vacuum in the variable volume chamber which draws fluid from the fluid source up into the flexible membrane of the variable volume chamber; and means for releasing fluid from the variable volume chamber into the buoyancy chamber, thereby floating the weighted movable lower component inside the buoyancy chamber and raising the variable volume chamber to an elevated position.

2. The system for moving fluid of claim 1, wherein the movement of fluid from the source to the flexible membrane is employed to do useful work.

3. The system for moving fluid of claim 1, wherein the following cycle is repeated:

(a) fluid is drawn by vacuum from the source at a lower elevation into the variable volume chamber at a higher elevation, (b) fluid is evacuated to the buoyancy chamber and is there used to float the variable volume chamber to an elevated position, and (c) fluid is then returned to the source from the buoyancy chamber.

4. The system for moving fluid of claim 1, further comprising manual or computer controlled valves and backflow prevention devices.

5. The system for moving fluid of claim 4, wherein after the filling of the weighted variable volume chamber, a first valve opens to allow the chamber to fill with air and a second valve opens to release the fluid in the variable volume chamber into the buoyancy chamber.

6. The system for moving fluid of claim 4, wherein a backflow prevention device prevents the supply side of the system from losing the fluid of the supply side of the system.

7. The system for moving fluid of claim 4, wherein valves are closed in the weighted variable volume chamber to return it to a vacuum ready state, and valves are opened in the buoyancy chamber to allow the fluid to be evacuated or to return the fluid to the holding tank.

8. The system for moving fluid of claim 4, wherein evacuating the fluid from the buoyancy chamber eliminates the buoyancy of the weighted component of the variable volume chamber, and the cycle repeats itself.

9. The system for moving fluid of claim 2, wherein the useful work is selected from driving an electric generator and moving the fluid from a lower elevation to a higher elevation.

10. The system for moving fluid of claim 1, wherein the source of fluid comprises a holding tank, into which fluid is returned upon release from the buoyancy chamber.

11. The system for moving fluid of claim 1, wherein the system is designed to capture kinetic energy formed in two ways;

first, as fluid passes from a lower supply source to a chamber at a higher elevation, and second, as the fluid, in subsequent stages, passes from a higher elevation to a lower elevation.

12. The system for moving fluid of claim 11, wherein the system is designed to capture kinetic energy when fluid moves from the weighted variable volume chamber into the buoyancy chamber.

13. The system for moving fluid of claim 11, wherein the system is designed to capture kinetic energy when fluid moves from the buoyancy chamber to the holding tank.

14. A method of moving fluid from a source located at a lower elevation to a higher elevation and then either returning the fluid to its source and its original elevation, or alternatively to a level above its beginning lower elevation comprising the steps of:

(a) filling a buoyancy chamber with a fluid, said buoyancy chamber being located beneath a variable volume chamber fillable with a fluid, the chamber comprising an upper section and a lower section connected to one another by a flexible membrane; the upper section of the variable volume chamber being operatively connected to a source of fluid; and the lower section of the chamber comprising a movable weighted lower component upon which the effect of gravity is greater than the weight of the chamber;

(b) using the fluid in the buoyancy chamber to raise the weighted movable lower component of the variable volume chamber into an elevated position inside the buoyancy chamber; and (c) releasing the fluid from the buoyancy chamber, whereby gravity acting upon the movable weighted lower component of the chamber pulls the weighted lower component down into the buoyancy chamber and creates a vacuum which draws fluid from a fluid source up into the flexible membrane of the variable volume chamber.

15. The method of moving fluid of claim 14, wherein the movement of fluid from the source to the flexible membrane is employed to do useful work.

16. The method of moving fluid of claim 15, wherein the useful work is selected from converting the energy of the moving water to another form, and moving the fluid from a lower elevation to a higher elevation.

17. The method of moving fluid of claim 14, wherein the following cycle is repeated:

(a) drawing fluid by vacuum from the source at a lower elevation into the variable volume chamber at a higher elevation, (b) releasing fluid from the variable volume chamber into the buoyancy chamber, thereby floating the variable volume chamber to an elevated position, and (c) releasing the fluid from the buoyancy chamber so that steps (a) and (b) can be performed again.

18. The method of moving fluid of claim 14, wherein valves and backflow prevention devices are controlled manually, or by computer, or by a combination thereof.

19. The method of moving fluid of claim 16, wherein kinetic energy formed by moving fluid is captured in one or more of two ways;

first, as fluid passes from a lower elevation source to the variable volume chamber at a higher elevation, and second, as the fluid, in subsequent stages, passes from a higher elevation to a lower elevation.

20. The method of moving fluid of claim 19, wherein kinetic energy formed by moving fluid is captured when fluid moves from the weighted variable volume chamber into the buoyancy chamber.

21. The method for moving fluid of claim 19, wherein kinetic energy formed by moving fluid is captured when fluid moves from the buoyancy chamber to the holding tank.

* * * * *